US007874449B1

(12) United States Patent
Studee et al.

(10) Patent No.: US 7,874,449 B1
(45) Date of Patent: Jan. 25, 2011

(54) SNACK TRAY WITH DISPENSING COMPARTMENT

(75) Inventors: Stephen B. Studee, Cross Plains, WI (US); Robert G. LaMasney, Cross Plains, WI (US)

(73) Assignee: Plastic Ingenuity, Inc., Cross Plains, WI (US)

( * ) Notice: Subject to any disclaimer, the term of this patent is extended or adjusted under 35 U.S.C. 154(b) by 761 days.

(21) Appl. No.: 11/751,533

(22) Filed: May 21, 2007

Related U.S. Application Data

(63) Continuation-in-part of application No. 29/277,799, filed on Mar. 9, 2007, now Pat. No. Des. 562,132, and a continuation-in-part of application No. 29/277,872, filed on Mar. 12, 2007, now Pat. No. Des. 598,743.

(51) Int. Cl.

| | |
|---|---|
| ***B65D 1/24*** | (2006.01) |
| ***B65D 1/36*** | (2006.01) |
| ***A47G 23/06*** | (2006.01) |
| ***A47G 23/08*** | (2006.01) |
| *B65D 85/00* | (2006.01) |

(52) U.S. Cl. ..... 220/502; 206/219; 206/541; 206/561; 206/564; 206/565; 220/23.8; 220/501; 220/504; 220/523; 220/556; 220/575; 220/DIG. 12; D9/761

(58) Field of Classification Search ..... 206/219–221, 206/541, 557, 561, 564, 565, 568, 581; 220/23.8, 220/501–505, 523, 524, 526, 555, 556, 574, 220/575, 675, DIG. 12; D9/761
See application file for complete search history.

(56) References Cited

U.S. PATENT DOCUMENTS

| | | | | | |
|---|---|---|---|---|---|
| 876,808 | A | * | 1/1908 | Kinert | 220/575 |
| 1,520,402 | A | * | 12/1924 | Clemans | 220/23.8 |
| D89,791 | S | * | 5/1933 | Pittman | D7/555 |
| 2,003,895 | A | * | 6/1935 | Martin | 131/238 |
| D106,782 | S | * | 11/1937 | Benque | D7/553.1 |
| 2,307,882 | A | * | 1/1943 | Freud et al. | 220/23.4 |
| 2,843,287 | A | * | 7/1958 | Finley | 220/575 |
| 2,913,140 | A | * | 11/1959 | Vuillemenot | 220/210 |
| 3,223,127 | A | * | 12/1965 | Sidebottom | 141/364 |
| 3,456,346 | A | * | 7/1969 | Snyder | 30/310 |
| D228,345 | S | * | 9/1973 | Kleinman | D9/439 |
| 3,894,649 | A | * | 7/1975 | Nicholl | 220/575 |
| 3,915,355 | A | * | 10/1975 | Young | 222/478 |
| D248,056 | S | * | 5/1978 | Nepper | D12/419 |
| 4,208,006 | A | * | 6/1980 | Bixler et al. | 229/406 |
| D271,634 | S | * | 12/1983 | Rockwell | D12/419 |
| D293,767 | S | * | 1/1988 | Powers | D9/761 |
| 4,986,434 | A | * | 1/1991 | Prestyly, Jr. | 220/574 |
| 4,989,742 | A | * | 2/1991 | Powell | 220/23.4 |
| 5,038,982 | A | * | 8/1991 | Salveson | 224/42.11 |

(Continued)

*Primary Examiner*—Anthony Stashick
*Assistant Examiner*—Ned A Walker
(74) *Attorney, Agent, or Firm*—Rick L. Abegglen

(57) ABSTRACT

A thermoformed dispensing container comprises a plastic tray with a dispensing cavity having side walls that include a circular radial side wall portion with a gap, and a disc-shaped thermoformed plastic lid positioned for rotation within the circular radial side wall portion of the tray, the lid having side walls that include a door. The dispensing container can be placed in an open condition by rotating the lid to align the door of the lid with the gap of the tray, or in a closed position by moving the door of the lid away from the gap of the tray.

18 Claims, 13 Drawing Sheets

U.S. PATENT DOCUMENTS 5,167,973 A * 12/1992 Snyder ..... 426/115
5,241,835 A * 9/1993 Ascone ..... 62/372
D341,249 S * 11/1993 Scheurer ..... D12/420
5,328,051 A * 7/1994 Potter et al. ..... 220/575
5,363,755 A * 11/1994 Liang ..... 99/484
5,368,186 A * 11/1994 Yeh ..... 220/713
5,441,164 A * 8/1995 Beck et al. ..... 220/575
5,449,071 A * 9/1995 Levy ..... 206/569
D366,187 S * 1/1996 Van Den Kieboom .... D7/553.1
D375,931 S * 11/1996 Ferrigan ..... D12/419
5,570,797 A * 11/1996 Yeh ..... 215/228
RE35,437 E * 2/1997 Ascone ..... 62/372
D394,750 S * 6/1998 Iversen et al. ..... D3/313
D396,953 S * 8/1998 Iversen et al. ..... D3/310
5,788,081 A * 8/1998 Bates ..... 206/562
D398,481 S * 9/1998 Brown et al. ..... D7/554.2
5,857,583 A * 1/1999 Chantaca et al. ..... 220/523
5,878,908 A * 3/1999 Foley ..... 220/575
5,887,749 A * 3/1999 Schommer et al. ..... 220/575
D421,365 S * 3/2000 Miller et al. ..... D7/553.4
D427,139 S * 6/2000 Noval ..... D12/419
D429,964 S * 8/2000 Miller et al. ..... D7/553.4
6,152,302 A * 11/2000 Miller et al. ..... 206/549
6,360,885 B1 * 3/2002 Krueger et al. ..... 206/217
6,367,649 B1 * 4/2002 Balakumar ..... 220/575
6,520,366 B1 * 2/2003 Bradley et al. ..... 220/23.2
6,732,990 B2 * 5/2004 Hudson ..... 248/311.2
6,883,692 B2 * 4/2005 Harden et al. ..... 224/275
D578,353 S * 10/2008 LaMasney ..... D7/553.6
7,448,510 B2 * 11/2008 Pavlopoulos ..... 220/501
2002/0036205 A1 * 3/2002 Balakumar ..... 220/575

* cited by examiner

SNACK TRAY WITH DISPENSING COMPARTMENT

CROSS REFERENCE TO RELATED APPLICATIONS

This application claims priority to design patent application No. 29/277,799, filed Mar. 9, 2007, the disclosure of which is incorporated by reference. This application claims priority to design patent application No. 29/277,872, filed Mar. 12, 2007, the disclosure of which is incorporated by reference.

FIELD OF THE INVENTION

This invention relates generally to the field of containers. More particularly, the present invention relates to thermoformed containers having features to allow controlled dispensing of materials, such as foods, contained within the containers.

BACKGROUND OF THE INVENTION

The consumer products industry is constantly adapting containers for consumable products, such as ready-to-eat food items, in response to the increasingly sophisticated demands of consumers. For example, consumers increasingly desire food products that can be consumed at a time and location of the consumer's choosing. In a variety of industries, including but not limited to the food service industry, innovative packaging features can increase consumer demand and help differentiate product offerings in a competitive marketplace.

Thermoformed plastic containers are well known as containers for the sale of products, including but not limited to ready-to-eat foods. In the thermoforming or vacuum forming process for producing plastic articles, a section of a sheet or web of thermoplastic is heated to soften it, then the sheet is drawn into a mold by a vacuum, to assume the form of the mold before the sheet cools and hardens. Multiple individual plastic parts can be formed in this manner, such as the common "clamshell" plastic containers. The plastic containers can be sized and shaped to hold a wide variety of products. Additionally, the containers can be decoratively embossed.

Many thermoformed plastic containers, such as the common "clamshell" containers, include a base and a cover that together form a chamber. A consumable product, such as a ready-to-eat food, can be placed within the chamber formed by the base and cover. The cover may be attached to the base by a hinge and the cover may be fit to the base using an interference fit to hold the cover onto the base or to hold a hinged cover closed. Tabs and slots can also be used to hold the cover on the base, or to hold a hinged cover closed. However, thermoformed plastic containers are often pliable and the interference fit or tab connection can fail during storage or transportation of the container. Failure of the interference fit or tab and slot connection can cause the container to open, thereby spilling the contents of the container.

Other thermoformed plastic or foam containers, such as a disposable coffee cup and lid, also include a base and a cover that together form a chamber, with the cover fit to the base using an interference fit to hold the cover onto the base. The cover will often have an opening that allows some degree of controlled dispensing, for example using a cutout area that flexes to provide an opening for liquid. Other disposable coffee cup designs use a flap to cover an opening in the cover, with the flap held on the opening by an interference fit when the cup is in a closed position. Failure of the flexed cutout area or failure of the interference fit between the flap and the opening can cause the container to open, thereby spilling the contents of the container.

What is needed is a thermoformed dispensing container that allows controlled dispensing of materials or liquids while reducing the risk of spills during consumption, storage, and transport. What is further needed is such a container adapted for preparing and/or dispensing a combination of at least one liquid or semi-liquid material with one or more additional materials, while reducing the risk of spills during consumption, storage, and transport.

SUMMARY OF THE INVENTION

A first embodiment of the invention is a dispensing container comprising a thermoformed plastic tray that includes a dispensing cavity with side walls having a circular radial side wall portion with a gap; and a disc-shaped thermoformed plastic lid positioned for rotation within the circular radial side wall portion of the tray, the lid having side walls that include a door. The dispensing container can be placed in an open condition by rotating the lid to align the door of the lid with the gap of the tray, or in a closed position by moving the door of the lid away from the gap of the tray.

A second embodiment of the invention is a dispensing container kit comprising a thermoformed plastic tray that includes a dispensing cavity with side walls that include a circular radial side wall portion with a gap; and a disc-shaped thermoformed plastic lid dimensioned and configured to fit for rotation within the circular radial side wall portion of the tray, the lid having side walls that include a door.

A third embodiment of the invention is a method of using a dispensing container, comprising (a) providing a thermoformed plastic tray that includes a dispensing cavity with side walls that include a circular radial side wall portion with a gap; (b) providing a disc-shaped thermoformed plastic lid positioned for rotation within the circular radial side wall portion of the tray, the lid having side walls that include a door; and (c) rotating the lid to align the door of the lid with the gap of the tray to place the dispensing container in an open condition.

Further objects, features, and advantages of the invention will be apparent from the following detailed description when taken in conjunction with the accompanying drawings.

DETAILED DESCRIPTION OF THE INVENTION

Figure 1:
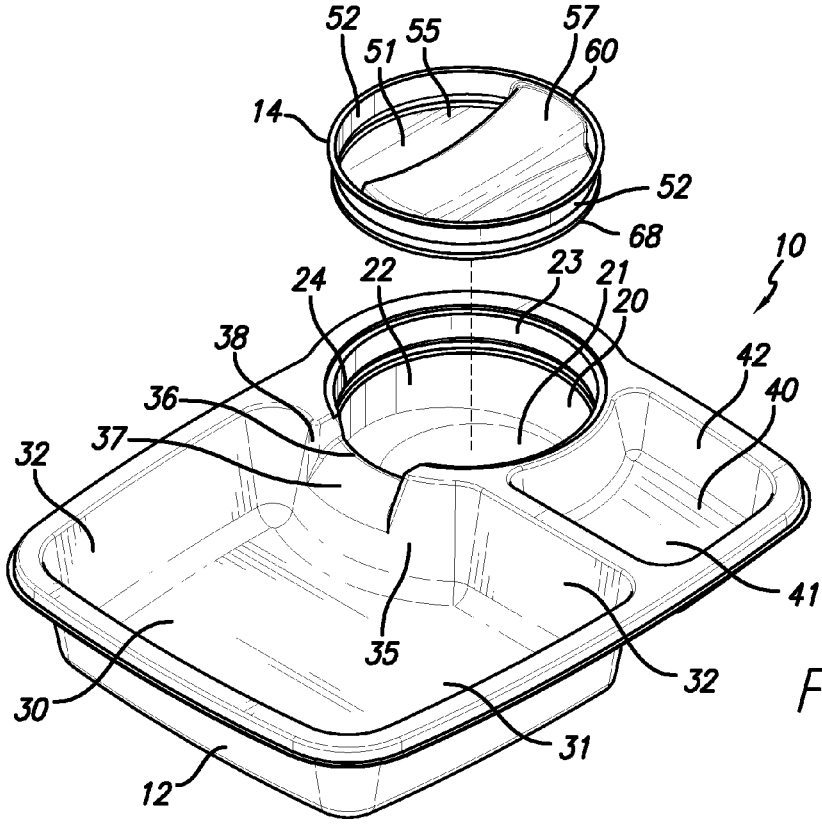
FIG. 1 is an exploded perspective view of a first embodiment of a dispensing container according to the invention.

FIGS. 1-13 provide various views of a first embodiment of a dispensing container according to the invention, indicated generally at 10. The dispensing container 10 includes a tray 12 and a lid 14. The exemplary tray 12 includes a dispensing cavity 20, a receiving cavity 30, and a third cavity 40, but this particular structure is not required. For example, a different number of cavities could be provided for particular applications, and the tray itself or the individual cavities could be different sizes and/or shapes.

Figure 2:
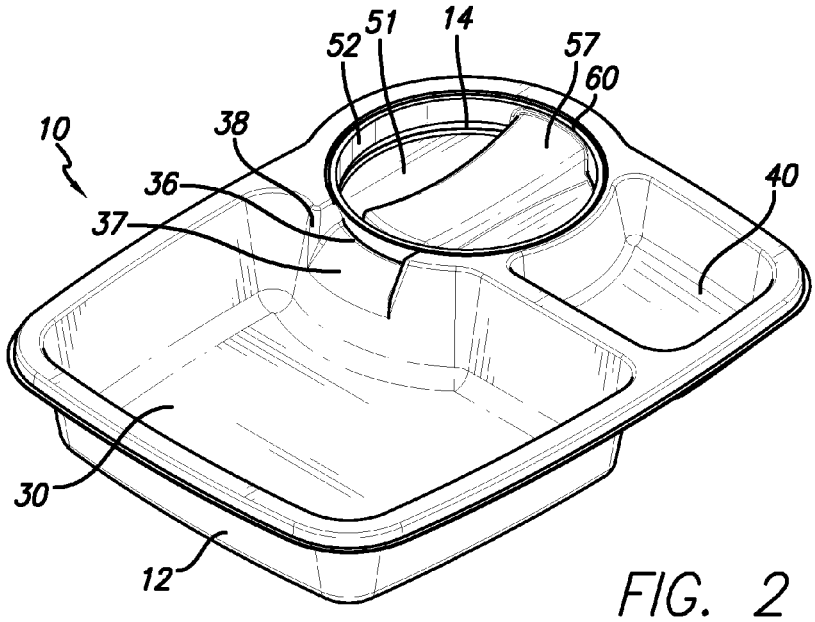
FIG. 2 is a perspective view of the assembled dispensing container of FIG. 1 in a closed state.
Figure 3:
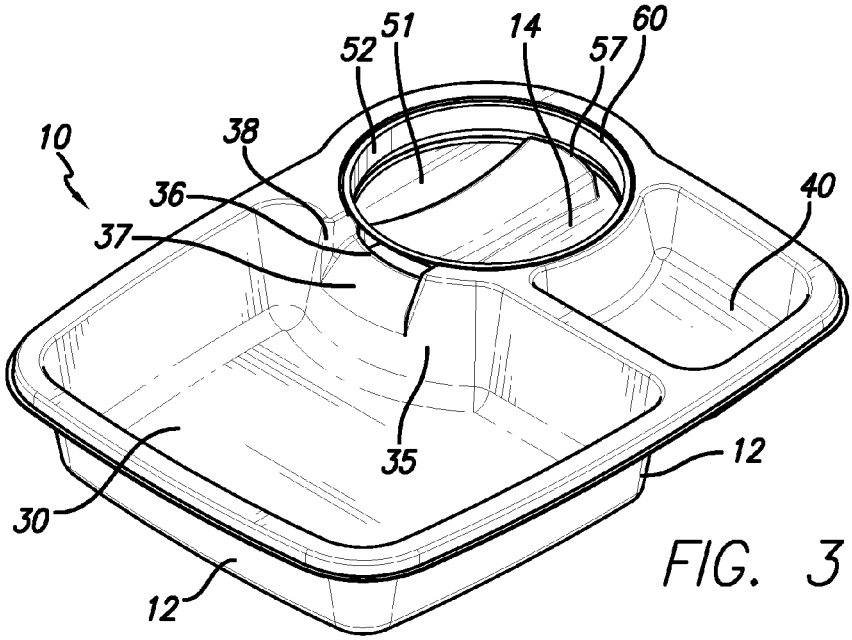
FIG. 3 is a perspective view of the assembled dispensing container of FIG. 1 in an open state.
Figure 4:
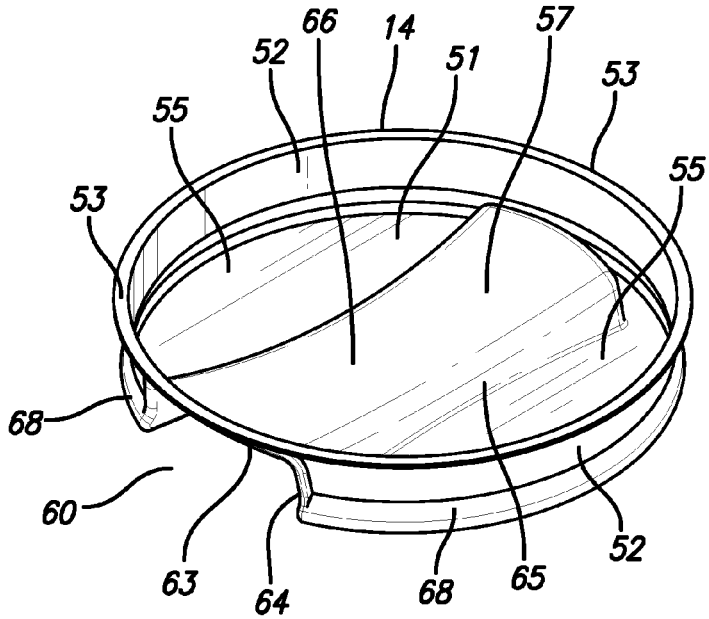
FIG. 4 is a perspective view of the lid of FIG. 1.
Figure 5:
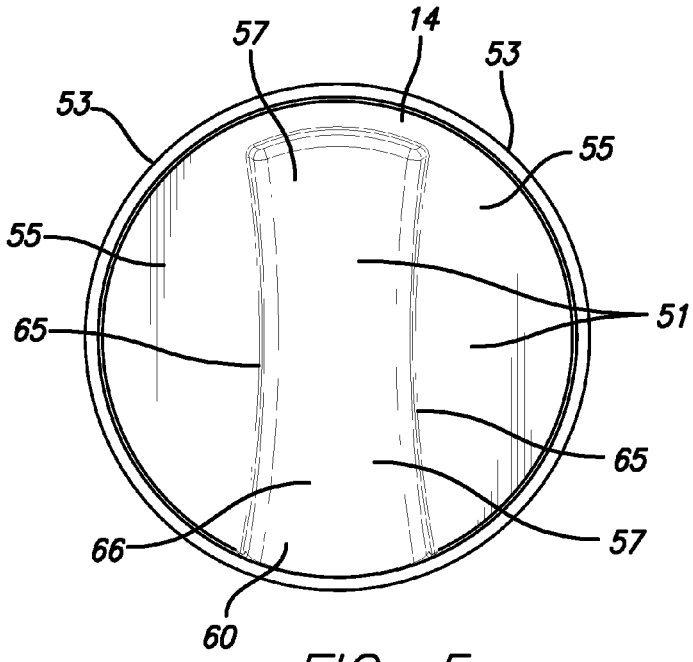
FIG. 5 is a top view of the lid of FIG. 1.
Figure 6:
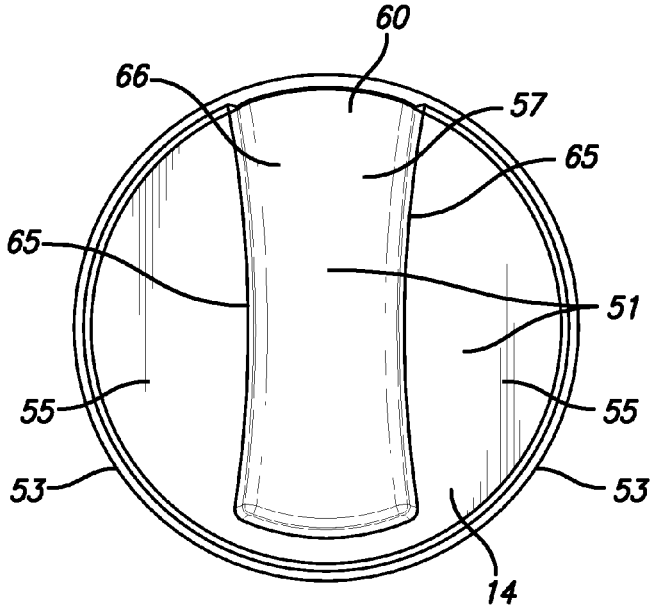
FIG. 6 is a bottom view of the lid of FIG. 1.
Figure 7:
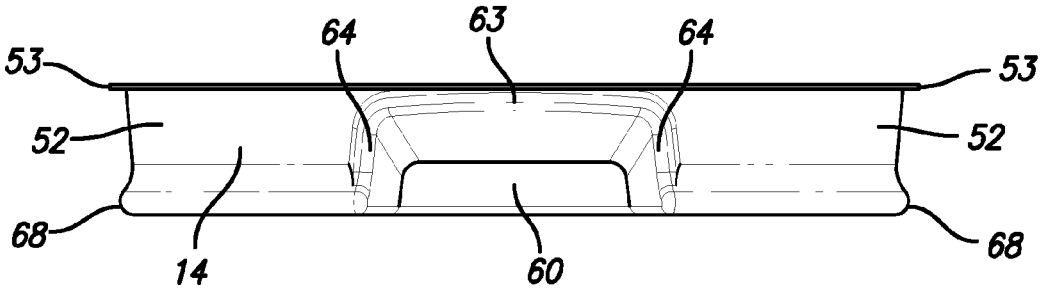
FIG. 7 is a side view of the lid of FIG. 1, looking at the open side.
Figure 8:
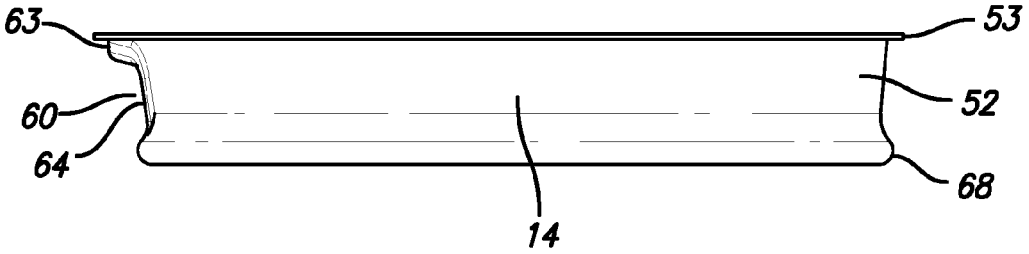
FIG. 8 is a side view of the lid of FIG. 1, looking at a closed side orthogonal to the open side of the lid.
Figure 9:
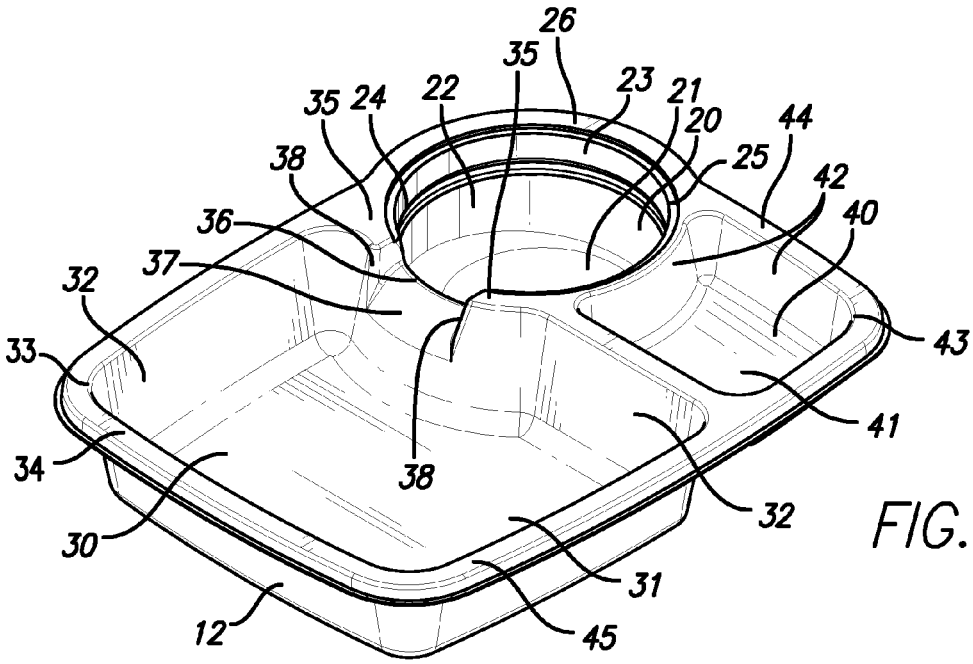
FIG. 9 is a perspective view of the tray of FIG. 1.
Figure 10:
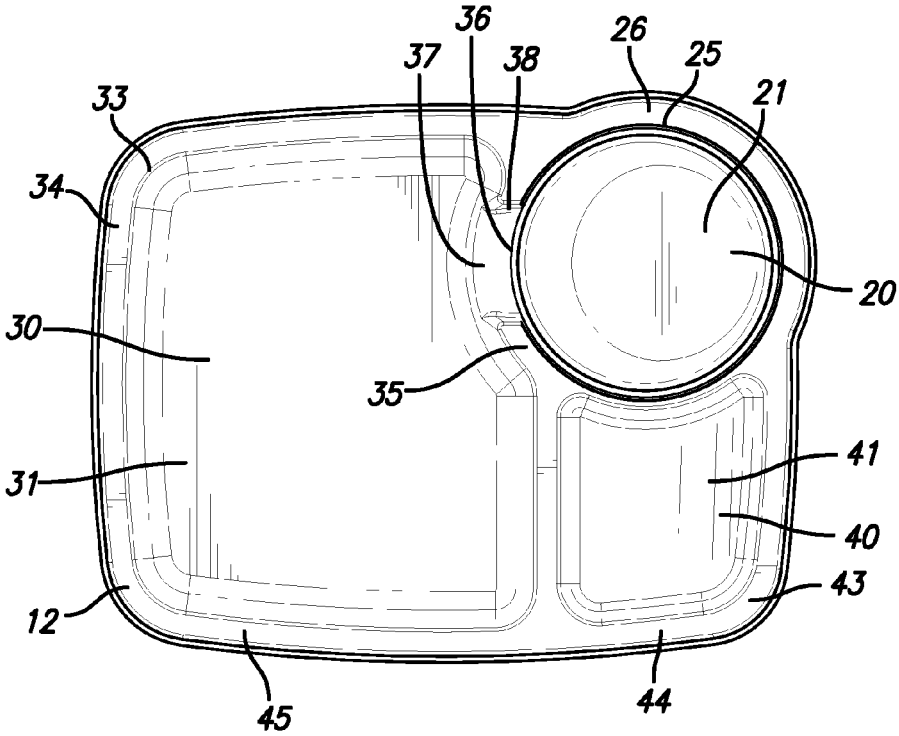
FIG. 10 is a top view of the tray of FIG. 1.
Figure 11:
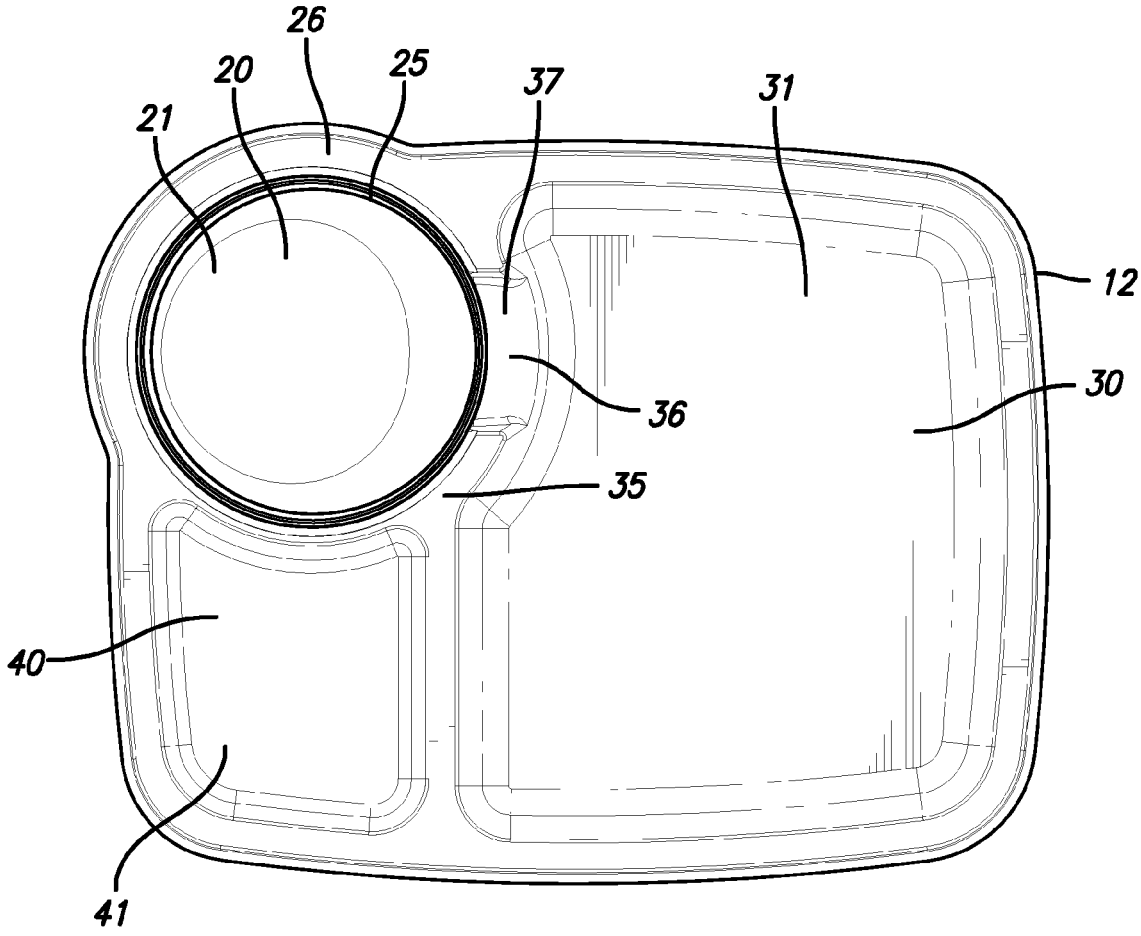
FIG. 11 is a bottom view of the tray of FIG. 1.
Figure 12:
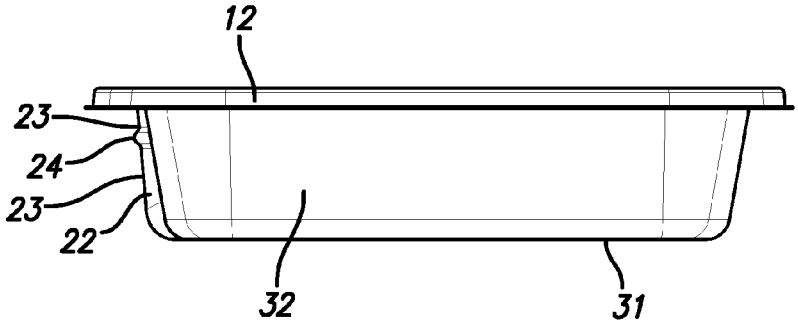
FIG. 12 is a side view of the tray of FIG. 1, looking at the short side adjacent to the receiving cavity.
Figure 13:
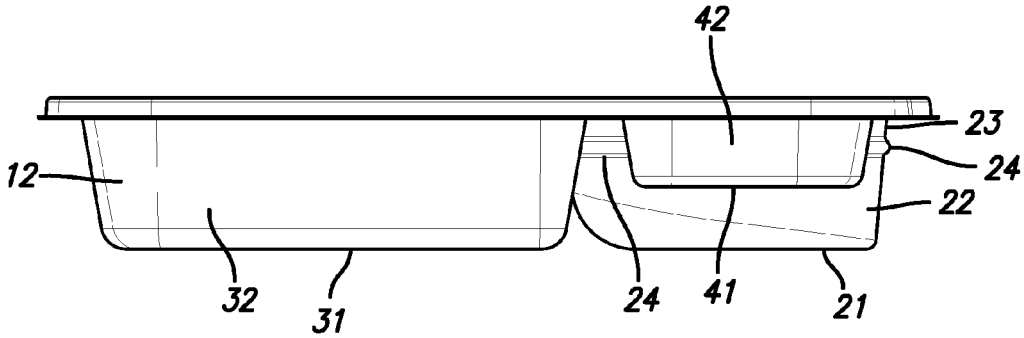
FIG. 13 is a side view of the tray of FIG. 1, looking at the long side adjacent to the receiving cavity and the secondary cavity.
Figure 14:
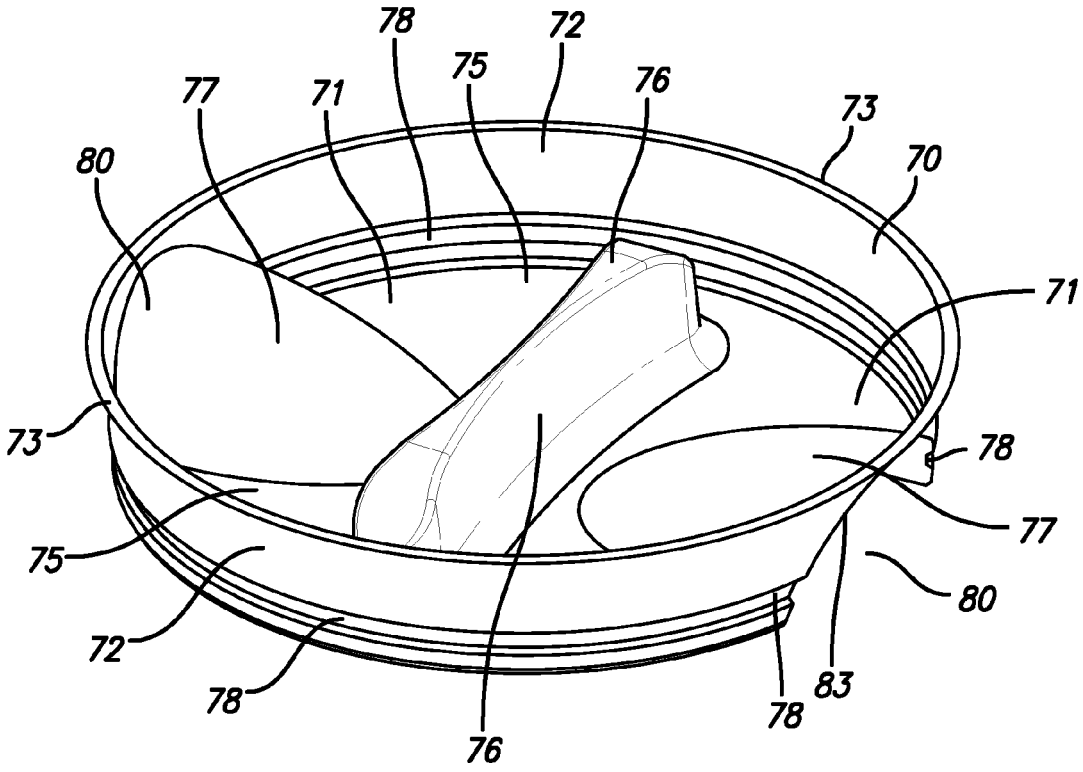
FIG. 14 is a perspective view of a second embodiment of a lid for use in a dispensing container according to the invention.
Figure 15:
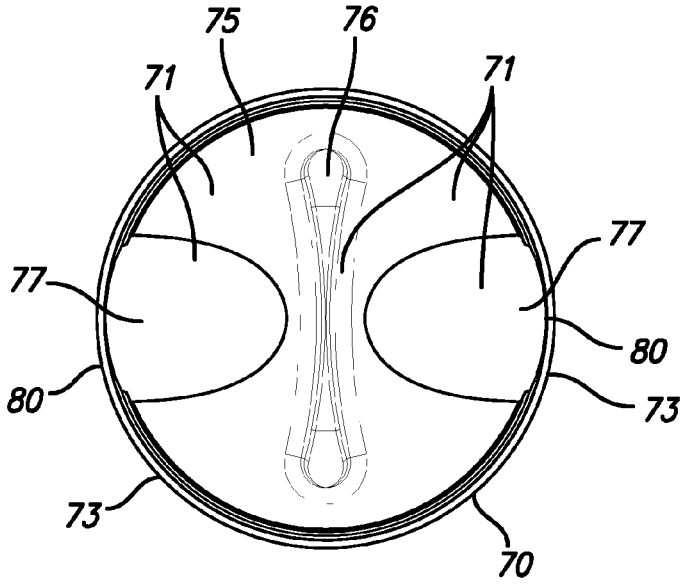
FIG. 15 is a top view of the lid of FIG. 14.
Figure 16:
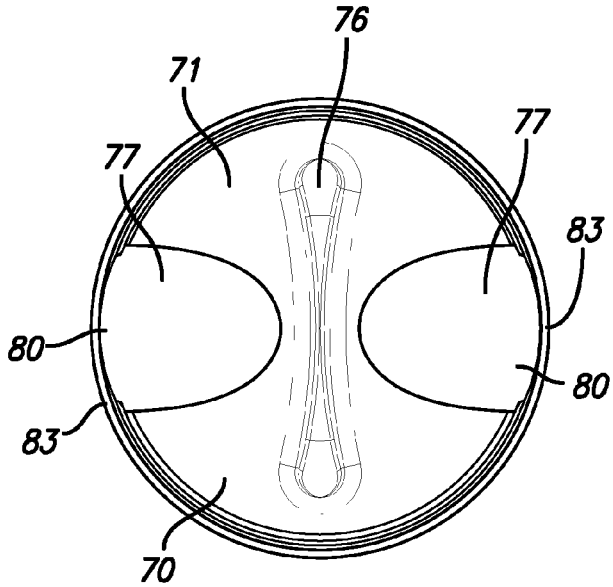
FIG. 16 is a bottom view of the lid of FIG. 14.
Figure 17:
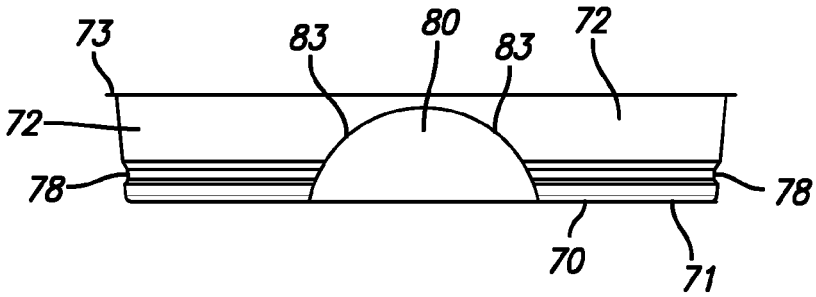
FIG. 17 is a side view of the lid of FIG. 14, looking at an open side.
Figure 18:
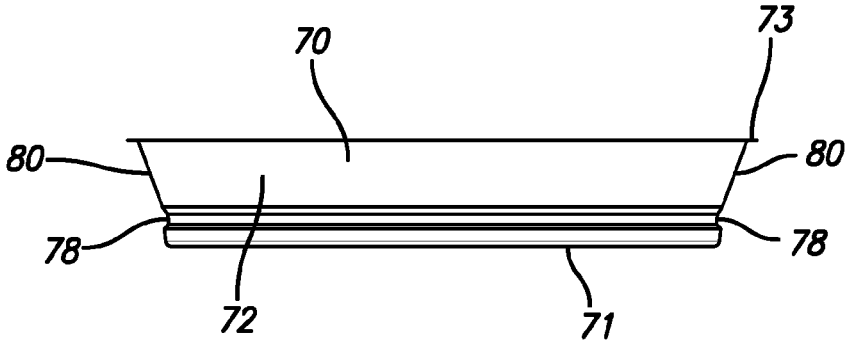
FIG. 18 is a side view of the lid of FIG. 14, looking at a closed side orthogonal to the open sides of the lid.
Figure 19:
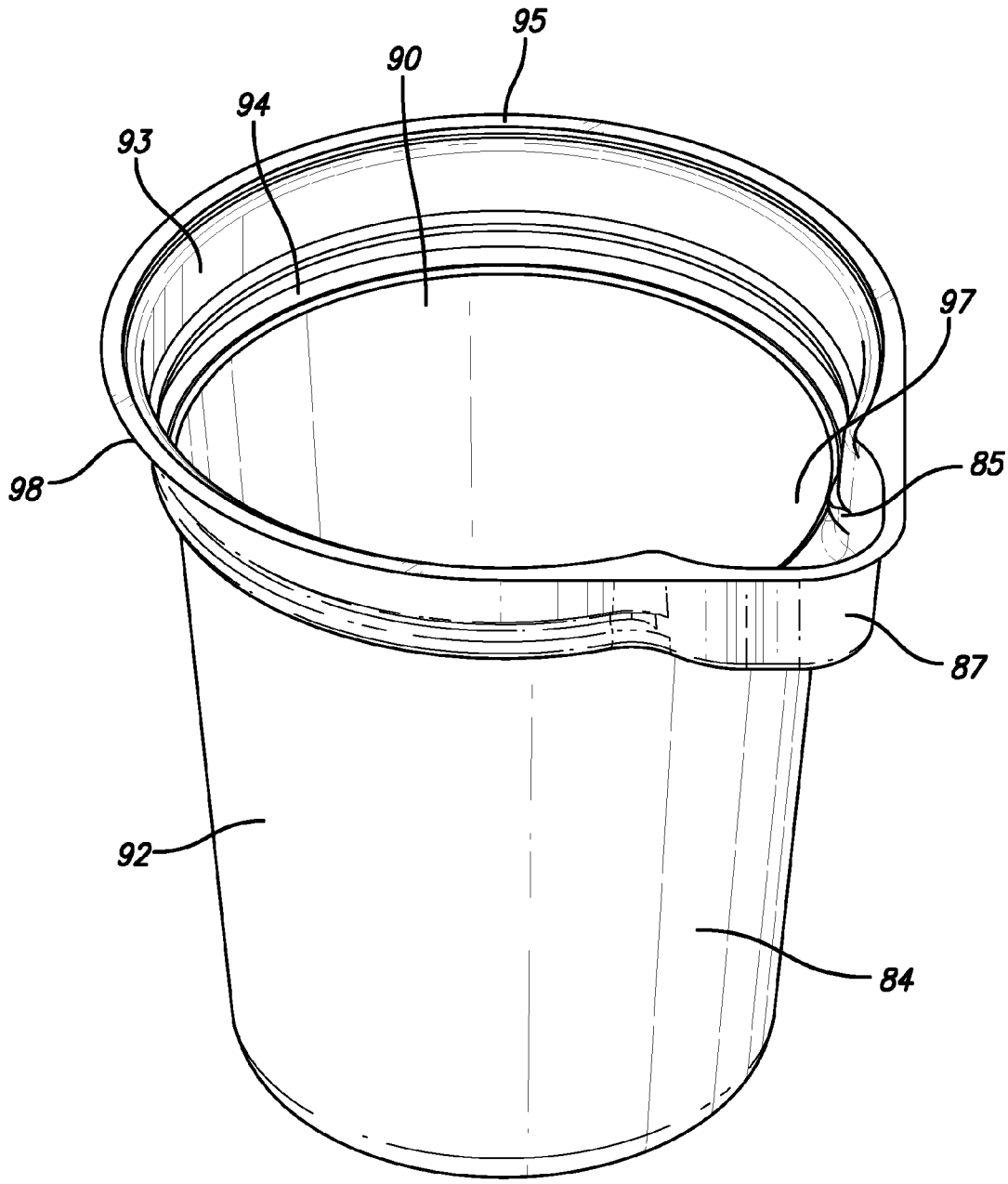
FIG. 19 is a perspective view of an embodiment of a cup for use in a dispensing container according to the invention.
Figure 20:
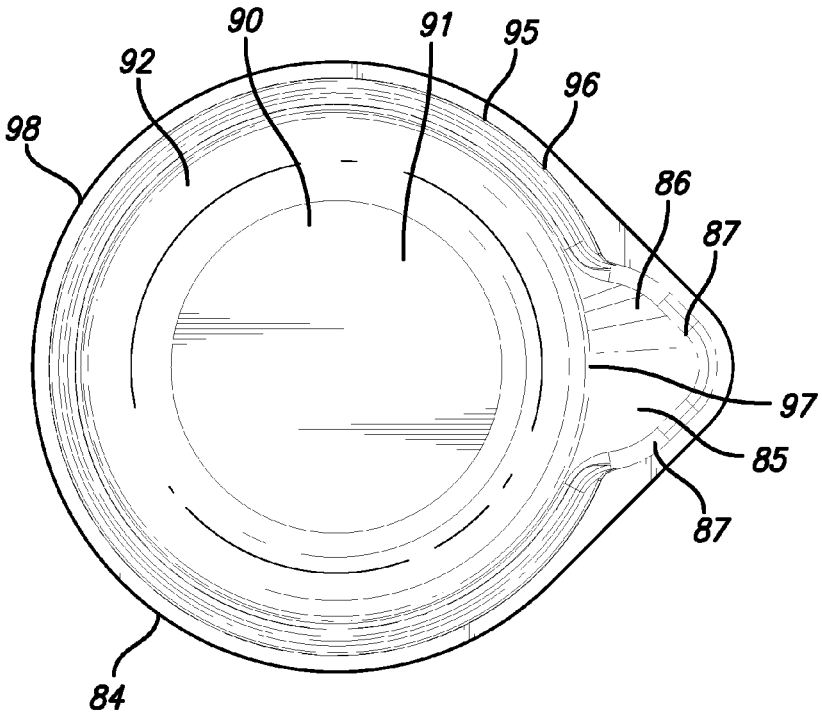
FIG. 20 is a top view of the cup of FIG. 19.
Figure 21:
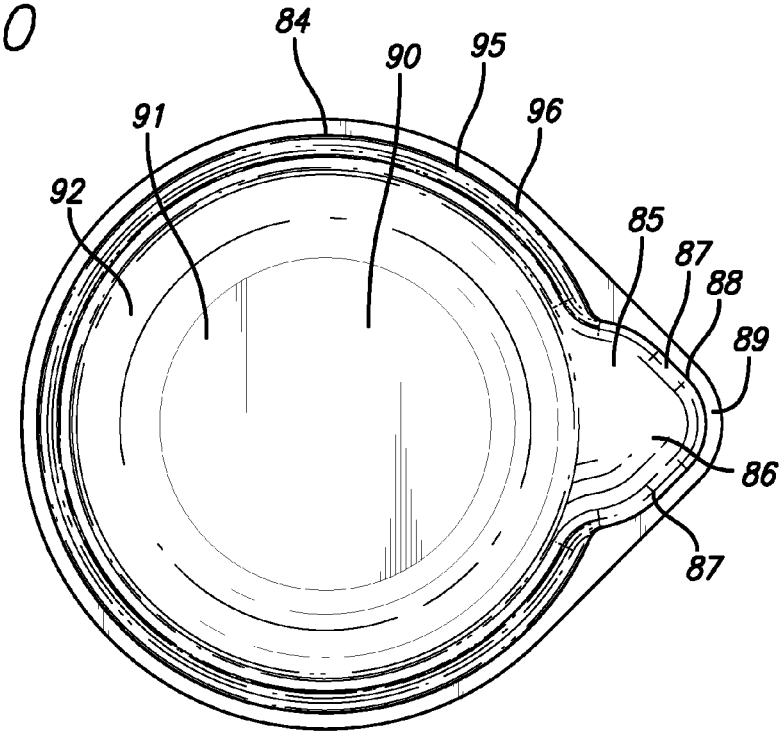
FIG. 21 is a bottom view of the cup of FIG. 19.
Figure 22:
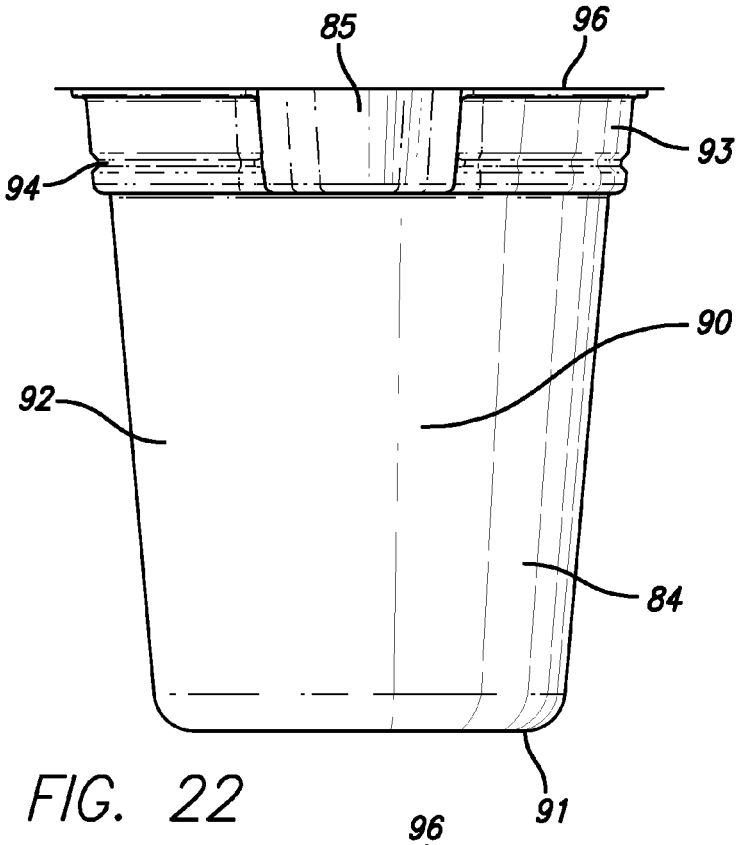
FIG. 22 is a side view of the cup of FIG. 19, looking at the side that includes the rim opening and receiving cavity.
Figure 23:
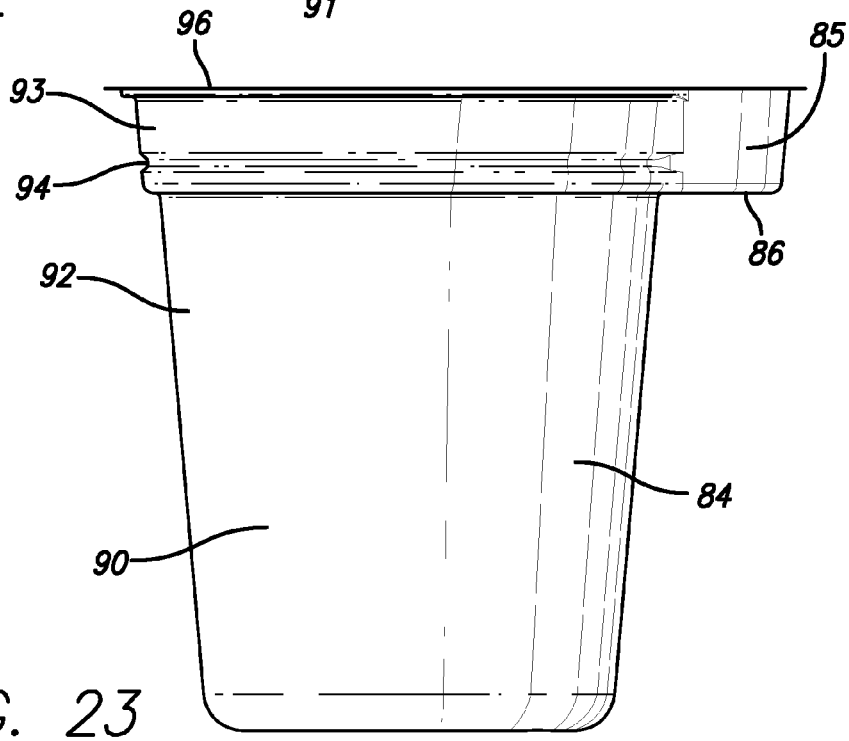
FIG. 23 is a side view of the cup of FIG. 19, looking at a side orthogonal to the side that includes the rim opening and receiving cavity.

FIGS. 2-3 illustrate the basic operation of the dispensing container 10, with the lid 14 engaged with the dispensing cavity 20 of the tray 12. FIG. 2 shows the dispensing container 10 with the lid 14 rotated to a closed position, where liquid or other material, such as ready-to-eat food, is retained within the dispensing cavity 20. FIG. 3 shows the dispensing container 10 with the lid 14 rotated to an open position, where liquid or other material, such as ready-to-eat food, can flow from the dispensing cavity 20 to the receiving cavity 30.

This structure allows the dispensing container 10 to provide reclosable and controlled dispensing of liquids or semi-liquid materials (such as ready-to-eat foods including microwaveable sauces, nacho cheese, hot fudge, etc.) from the dispensing cavity 20 to the receiving cavity 30. The receiving cavity may hold complementary materials (for example, foods such as ribs, tortilla chips, or ice cream). The dispensing container 10 can also help to maintain temperature of materials in the dispensing cavity 20, for example after they have been heated in a microwave. The dispensing container 10 can also provide reclosable storage during use or transport.

The tray 12 and lid 14 of the dispensing container 10 are preferably made using thermoforming methods, from a suitable thermoformable material. For example, a dispensing container 10 for ready-to-eat foods might be formed of a thermoformable plastic such as oriented polystyrene (OPS), talc-filled polypropylene (TFPP), polypropylene (PP), high impact polystyrene (HIPS), polyethylene terepthalate (PET), amorphous PET (APET), crystalline polyethylene (CPET) polystyrene copolymer blends, styrene block copolymer blends, and the like. The materials forming the tray 12 and lid 14 may be different, and those materials are not necessarily homogeneous, but may be, for example, a laminate, co-extruded material, or multilayer material.

FIGS. 5-8 illustrate the lid 14 of the dispensing container 10. The lid 14 is generally shaped as a circular disc, with a floor 51 and side walls 52 integrally formed with and extending upward from the floor 51. The side walls 52 may terminate in a flange or lip 53. The floor 51 includes a lower portion 55 and a raised portion 57 that terminates in a side wall 52. The raised portion 57 forms a door 60 in the side wall 52 with an upper door edge 63 and lateral door edges 64, although the door 60 is not necessarily rectangular. The raised portion 57 includes lateral walls 65 integrally formed with and extending from the lower portion 55 to a ceiling 66. The side walls 52 include a protrusion 68.

FIGS. 9-13 illustrate the tray 12 of the container 10. The dispensing cavity 20 includes a floor 21, and side walls 22 integrally formed with and extending upward from the floor 21 through a circular radial side wall portion 23 that includes a groove 24. The side walls 22 terminate in a dispensing cavity rim 25 that includes a dispensing cavity rim top surface 26. The receiving cavity 30 includes a floor 31, and side walls 32 integrally formed with and extending upward from the floor 31. The side walls 32 terminate in a receiving cavity rim 33 that includes a receiving cavity rim top surface 34. The third cavity 40 includes a floor 41, and side walls 42 integrally formed with and extending upward from the floor 41. The side walls 42 terminate in a third cavity rim 43 that includes a third cavity rim top surface 44.

The tray 12 includes a substantially planar top surface 45 that includes the dispensing cavity rim top surface 26, the receiving cavity rim top surface 34, and the third cavity rim top surface 44. In a particular application, a sheet material (not shown) could be affixed to the top surface 45 of the tray 12, for example by thermal bonding or by glue, to seal materials such as ready-to-eat foods into the separate cavities.

The receiving cavity 30 is adjacent to the dispensing cavity 20, and separated by a partition 35 formed by the receiving cavity side walls 32, rim 33, and rim top surface 34, and the dispensing cavity side walls 22, radial side wall portion 23, cavity rim 25, and rim top surface 26. The partition 35 includes a gap 36 that includes a gap floor 37 and lateral walls 38. The gap floor 37 can be sloped from the dispensing cavity 20 to the receiving cavity 30 to facilitate the gravity flow of material from the dispensing cavity 20 to the receiving cavity 30.

As best shown in FIGS. 2-3, the dispensing container 10 is assembled by engaging the lid 14 with the dispensing cavity 20 of the tray 12. The lid 14 is configured to fit the circular radial side wall portion 23 of the dispensing cavity 20, and the protrusion 68 of the side walls 52 of the lid 14 is configured to nest into the groove 24 of the circular side wall portion 23. In this way, the lid 14 can be "snapped" into the circular radial side wall portion 23 so that the protrusion 68 and groove 24 provide an interference fit to retain the lid 14 on the dispensing cavity 20 while leaving the lid 14 free to rotate within the circular radial side wall portion 23. The protrusion 68 and groove 24 can also provide a seal to retain the contents of the dispensing cavity 20, for example during storage or transport.

FIG. 2 shows the dispensing container 10 with the lid 14 rotated to a closed position, wherein the door 60 of the lid 14 is not aligned with the gap 36 in the partition 35 between the dispensing cavity 20 and the receiving cavity 30. In FIG. 2, the door 60 is rotated diametrically opposite the gap 36, although this is not the only closed position since any rotation that does not align any portion of the door 60 with any portion of the gap 36 is a closed position.

FIG. 3 shows the dispensing container 10 with the lid 14 rotated to an open position, wherein the door 60 of the lid 14 is fully aligned with the gap 36 in the partition 35 between the dispensing cavity 20 and the receiving cavity 30. In FIG. 2, the door 60 is rotated to be fully aligned with the gap 36, although this is not the only open position since any rotation that aligns a portion of the door 60 with a portion of the gap 36 is a partially or completely open position.

FIGS. 14-18 illustrate an alternative lid 70 for use in a dispensing container. Like the lid 14, the lid 70 is generally shaped as a circular disc, with a floor 71 and side walls 72 integrally formed with and extending upward from the floor 71. The side walls 72 may terminate in a flange or lip 73. The floor 71 includes a lower portion 75, a central raised grip portion 76, and two convex lateral raised portions 77 each terminating in a side wall 72. Each of the lateral raised portions 77 forms a door 80 in the side wall 72 with a roughly semi-circular door edge 83, although the door 80 is not necessarily that shape. The central raised portion 76 is preferably shaped to provide an easy-to-grip knob for easier rotation of the lid 70. The side walls 72 include a groove 78.

FIGS. 19-23 illustrate a tray 84 for use in a dispensing container, for example in combination with the alternative lid 70. The tray 84 includes a catcher 85 and a dispensing cavity 90 that may be generally cup-shaped, although this is not required. The dispensing cavity 90 includes a floor 91, and side walls 92 integrally formed with and extending upward from the floor 91 through a circular radial side wall portion 93 that includes a protrusion 94. The side walls 92 terminate in a dispensing cavity rim 95 that includes a dispensing cavity rim top surface 96.

The circular radial side wall portion 93 includes a gap 97 between the dispensing cavity 90 and the catcher 85. The catcher 85 includes integrally formed floor 86 and side walls 87 extending from the circular radial side wall portion 93. The side walls 87 terminate in a catcher rim 88 that includes a catcher rim top surface 89.

The alternative tray 84 includes a substantially planar top surface 98 that includes the dispensing cavity rim top surface 96 and the catcher rim top surface 89. In a particular application, a sheet material (not shown) could be affixed to the top surface 98 of the tray 84, for example by thermal bonding or by glue, to seal materials such as ready-to-eat foods into the separate cavities.

As with the dispensing container 10 of FIGS. 2-3, an alternative dispensing container can be assembled by engaging the lid 70 with the tray 84. This alternative dispensing container can be used, for example, with ready-to-eat foods such as cereal, candies, nuts, raisins, or granola. The lid 70 is configured to fit the circular radial side wall portion 93, with the protrusion 94 of the tray configured to nest into the groove 78 of the lid 70. In this way, the lid 70 can be "snapped" into the circular radial side wall portion 93 so that the protrusion 94 and groove 78 provide an interference fit to retain the lid 70 on the dispensing cavity 90 while leaving the lid 70 free to rotate, and to provide a seal.

The alternative dispensing container operates like the dispensing container 10. The alternative dispensing container has an open position with the lid 70 rotated to align a door 80 with the gap 97, and a closed position with the lid 70 rotated so that no part of a door 80 is aligned with the gap 97. During use, the alternative dispensing container can be placed in an open position, then shaken to dispense a limited portion from the dispensing cavity 90 into the catcher for consumption.

It is understood that the invention is not confined to the embodiments set forth herein as illustrative, but embraces all such forms thereof that come within the scope of the following claims.

What is claimed is:

1. A dispensing container, comprising:

a thermoformed plastic tray that includes a dispensing cavity having a cavity floor with cavity side walls integrally formed with and extending upward from the cavity floor to a dispensing cavity rim top surface, wherein the cavity side walls include a circular radial side wall portion with a gap extending downward from the dispensing cavity rim top surface to a gap floor located at a vertical position substantially above the cavity floor;

a disc-shaped thermoformed plastic lid positioned for rotation within the circular radial side wall portion of the tray, the lid having a lid floor with lid side walls integrally formed with and extending from the lid floor, wherein the lid floor includes a raised portion that terminates in a lid side wall to form a door in the lid side wall and wherein the gap floor is sloped downward in a direction away from the cavity floor;

whereby the dispensing container can be placed in an open condition by rotating the lid to align the door of the lid with the gap of the tray, or in a closed position by moving the door of the lid away from the gap of the tray.

2. The dispensing container of claim 1 wherein the tray further comprises a receiving cavity adjacent to the dispensing cavity, with the receiving cavity and dispensing cavity separated by a partition that includes the gap of the tray.

3. The dispensing container of claim 1 wherein the lid side wall includes a protrusion, and wherein the circular radial side wall portion of the tray includes a groove dimensioned to receive the protrusion.

4. The dispensing container of claim 1 wherein the lid side wall includes a groove, and wherein the circular radial side wall portion of the tray includes a protrusion dimensioned to fit the groove.

5. The dispensing container of claim 1, wherein the cavity side walls have a cavity side wall height measured from the cavity floor to the dispensing cavity rim top surface, and wherein the gap extends downward from the dispensing cavity rim top surface to the gap floor for a distance no more than 50% of the cavity side wall height.

6. The dispensing container of claim 1 wherein the tray is formed as a cup, and further comprising a catcher adjacent to the dispensing cavity, with the catcher having a catcher floor and catcher side walls integrally formed with and extending from the circular radial side wall portion.

7. The dispensing container of claim 6 wherein the lid side wall includes a protrusion, and wherein the circular radial side wall portion of the tray includes a groove dimensioned to receive the protrusion.

8. The dispensing container of claim 6 wherein the lid side wall includes a groove, and wherein the circular radial side wall portion of the tray includes a protrusion dimensioned to fit the groove.

9. A dispensing container kit, comprising:

a thermoformed plastic tray that includes a dispensing cavity having a cavity floor with cavity side walls integrally formed with and extending from the cavity floor upward to a dispensing cavity rim top surface, wherein the cavity side walls include a circular radial side wall portion with a gap extending from the dispensing cavity rim top surface downward to a gap floor that slopes downward in a direction away from the cavity floor and the gap floor is located at a vertical position substantially above the cavity floor; and a disc-shaped thermoformed plastic lid dimensioned and configured to fit for rotation within the circular radial side wall portion of the tray, the lid having a lid floor with lid side walls integrally formed with and extending from the lid floor, wherein the lid floor includes a raised portion that terminates in a lid side wall to form a door in the lid side wall whereby the dispensing container can be placed in an open condition by rotating the lid to align the door of the lid with the gap of the tray, or in a closed position by moving the door of the lid away from the gap of the tray.

10. The kit of claim 9 wherein the tray further comprises a receiving cavity adjacent to the dispensing cavity, with the receiving cavity and dispensing cavity separated by a partition that includes the gap of the tray.

11. The kit of claim 9 wherein the lid side wall includes a protrusion, and wherein the circular radial side wall portion of the tray includes a groove dimensioned to receive the protrusion.

12. The kit of claim 9 wherein the lid side wall includes a groove, and wherein the circular radial side wall portion of the tray includes a protrusion dimensioned to fit the groove.

13. The dispensing container kit of claim 9, wherein the cavity side walls have a cavity side wall height measured from the cavity floor to the dispensing cavity rim top surface, and wherein the gap extends downward from the dispensing cavity rim top surface to the gap floor for a distance no more than 50% of the cavity side wall height.

14. The kit of claim 9 wherein the tray is formed as a cup, and further comprising a catcher adjacent to the dispensing cavity, with the catcher having a catcher floor and catcher side walls integrally formed with and extending from the circular radial side wall portion.

15. The kit of claim 14 wherein the lid side wall includes a protrusion, and wherein the circular radial side wall portion of the tray includes a groove dimensioned to receive the protrusion.

16. The kit of claim 14 wherein the lid side wall includes a groove, and wherein the circular radial side wall portion of the tray includes a protrusion dimensioned to fit the groove.

17. A dispensing container, comprising:

a thermoformed plastic tray that includes a dispensing cavity having a cavity floor with cavity side walls integrally formed with and extending from the cavity floor upward to a dispensing cavity rim top surface, wherein the cavity side walls include a circular radial side wall portion with a gap extending from the dispensing cavity rim top surface downward to a gap floor that slopes downward in a radial direction away from the cavity floor and the gap floor is located at a vertical position substantially above the cavity floor; and a disc-shaped thermoformed plastic lid positioned for rotation within the circular radial side wall portion of the tray, the lid having a lid floor with lid side walls integrally formed with and extending from the lid floor, wherein the lid floor includes a raised portion that terminates in a lid side wall to form a door in the lid side wall;

whereby the dispensing container can be placed in an open condition by rotating the lid to align the door of the lid with the gap of the tray, or in a closed position by moving the door of the lid away from the gap of the tray.

18. The dispensing container of claim 17 wherein the cavity side walls have a cavity side wall height measured from the dispensing cavity floor to the cavity rim top surface, and wherein the gap extends downward from the dispensing cavity rim top surface to the gap floor for a distance no more than 50% of the cavity side wall height.

* * * * *